United States Patent [19]

Chapalain

[11] Patent Number: 4,525,007

[45] Date of Patent: Jun. 25, 1985

[54] DEVICE FOR LOCKING STRAPS AT THE TIME OF LIFTING LOADS, WITH POSSIBLE ADJUSTMENT OF THEIR USEFUL LENGTH

[76] Inventor: Jean-Pierre Chapalain, 8 À 18, rue de Méry, 95310 Saint Ouen l'Aumone, France

[21] Appl. No.: 419,910

[22] Filed: Sep. 20, 1982

[30] Foreign Application Priority Data

Sep. 7, 1982 [FR] France ..... 82 15159

[51] Int. Cl.[3] ..... B66C 1/18

[52] U.S. Cl. ..... 294/74

[58] Field of Search ..... 294/74, 75, 76, 77, 294/67 E, 67 EA, 78 R, 81 R, 83 R; 206/522

[56] References Cited

U.S. PATENT DOCUMENTS 3,712,482 1/1973 Bondowski ..... 294/74

3,934,919 1/1976 Smith ..... 294/74

*Primary Examiner*—James B. Marbert

[57] ABSTRACT

A device is provided for preferably adjustably fixing a strap or a two-piece strap for lifting a heavy load, such as the hull of a ship, and hooking it on to the lifting apparatus. It comprises a yoke shaped piece housing a removable case or box, secured thereto by engagement, in corresponding holes in the arms of the yoke and the sides of the case, of parallel shafts, the first two serving in a way known per se for locking the strap by winding same in loops and the third, which is removable, as means for adjusting its length. The arms of the yoke are extended by lugs pierced with holes, either for passing therethrough a removable pin serving for guiding the active strand of the strap towards its hooking point on to the lifting apparatus, or by means of a hook, ring or similar, or by means of a known device, or by engagement of a member for coupling together two pieces disposed head to tail, one receiving a load carrying strap and the other a strap for hooking on to the lifting apparatus.

9 Claims, 11 Drawing Figures

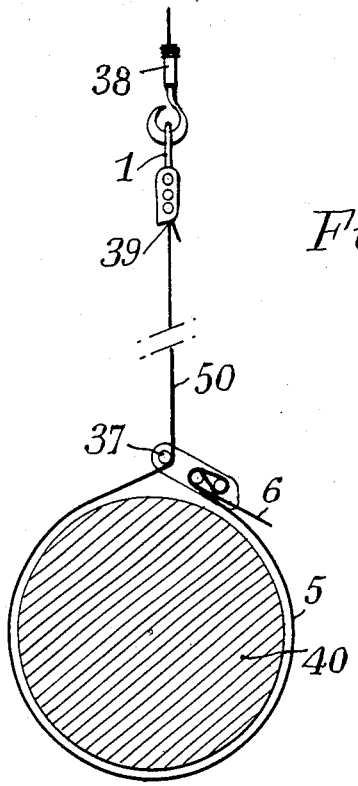
Fig. 1
Fig. 3
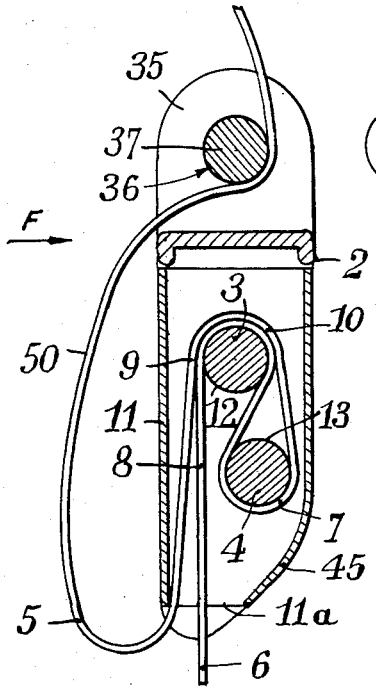
Fig. 2
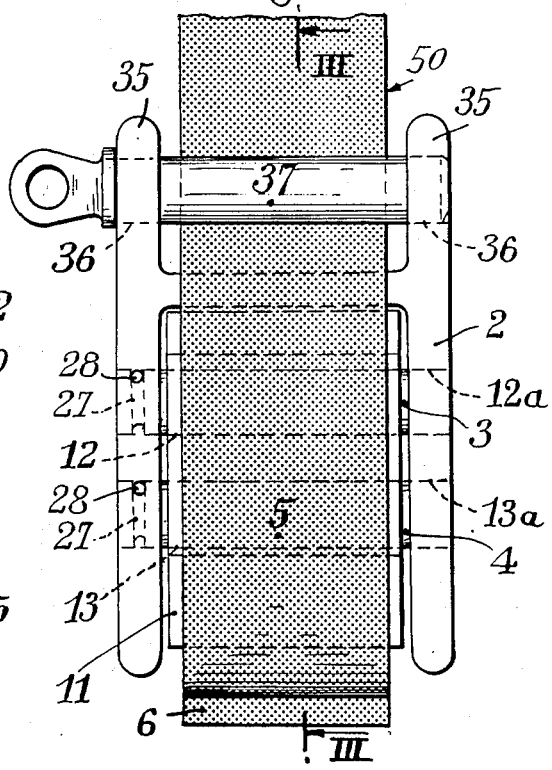

DEVICE FOR LOCKING STRAPS AT THE TIME OF LIFTING LOADS, WITH POSSIBLE ADJUSTMENT OF THEIR USEFUL LENGTH

BACKGROUND OF THE INVENTION

The present invention relates to a device for securing straps or webbing of apparatus for lifting or securing loads, with the possibility of adjusting the length thereof before locking at the time of use.

A device of this type has already been described in U.S. Pat. No. 4,365,391 comprising a yoke shaped piece housing a case whose sides are pierced with two or three pairs of holes provided opposite corresponding holes in the arms of the yoke, in which holes are engaged in parallel relation shafts serving both for securing the case in the yoke and adjusting and locking strap, whose free and active strands are superposed in the slit formed between the bottom of the case and the part of its cover bent back in the direction thereof.

Such a device comprises a hook for suspending the load lifting or securing apparatus.

Now, it is often desired to use the strap for suspending heavy loads, for example for surrounding the hull of a boat, and to use the active strand of the strap for surrounding the load and hooking on to the lifting apparatus.

SUMMARY OF THE INVENTION

To this end, in accordance with the invention, the device comprises, besides the yoke receiving the case carrying the locking shafts, or the shafts for adjusting the length of the strap and locking same, an extension of the arms of the yoke, in the form of lugs pierced with holes for passing therethrough a removable shaft intended for guiding the active strand of the strap towards the suspension member of the lifting apparatus by means of a ring, hook or advantageously with a device such as described in the above-mentioned U.S. Pat. No. 4,365,391.

The strap is wound in a figure of eight in the low part of the device around the locking shafts, as in the above-mentioned patent, and possibly around the upper shaft for adjusting the length thereof, then the active strand passes round the load to be lifted and slides over the guide shaft of the upper part of the device for securing same to the suspension member of the lifting means.

The pair of shafts for locking, the shaft for adjusting and the upper shaft for guiding the strap may be secured to the yoke and the case by screwing, pinning or otherwise.

It may be advantageous to choose interchangeable shafts for adjusting the length of the strap and for guiding the active strand, the shaft for adjustment being available after the length of the strap has been fixed and may then serve as guide shaft.

This shaft may advantageously receive a loose sleeve or a split ring facilitating sliding of the strap.

Such a device may then serve either alone, or in combination with a device such as described in the above-mentioned patent for hooking on to the lifting means, which allows adjustments to be carried out on one or other of these devices depending on their accessibility.

In some cases, instead of a single strap two straps are used disposed like a cradle under the load, for example for lifting a boat hull, and hooked on to the hook of the crane or other lifting apparatus, preferably with interpositioning of the above-mentioned adjustment devices.

It is then necessary to join the two straps together by means of a locking and length adjustment device.

To this end, the lugs of two similar yoke shaped pieces receiving the locking shafts and possibly the guide shafts, are adapted to be coupled together and are pierced with holes for engagment of a locking member, which may be advantageously one of the length adjustment shafts, the guide shafts becoming useless.

This arrangement allows locking and length adjustment to be carried out on the accesible device, either the one which serves for joining the two straps together or those which are hooked on to the lifting means.

Another advantage of this combined device is the possibility of using for each piece straps of different dimensions.

BRIEF DESCRIPTION OF THE DRAWINGS

There will be described hereafter an installation for lifting or stowing heavy loads, using in combination the device of the present invention and one of the devices described in U.S. Pat. No. 4,365,391, with reference to the accompanying drawings in which:

FIG. 1 is a general schematical view of the installation for lifting a load by means of a device of the present invention with a device for hooking on in accordance with the above-mentioned patent;

FIG. 2 is a front elevational view in the direction of arrow F of FIG. 3 and FIG. 3 is a sectional view along line III—III of FIG. 2, for a device without length adjustment means;

DESCRIPTION OF THE PREFERRED EMBODIMENTS

Figure 5:
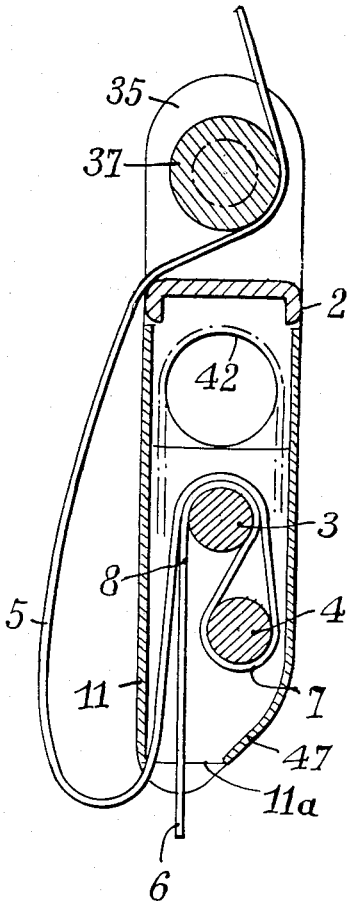
FIGS. 4 and 5 are views similar to FIGS. 2 and 3 of a device comprising a member for adjusting the strap length.

The invention applies principally to lifting heavy loads, for example boat hulls: the device receives the two strands 5,6 of the single strap 50 which is wound, forming a loop, around the pair of locking shafts as described in the above-mentioned U.S. Pat. No. 4,365,391; the active strand 5 is used for surrounding the load 40 and returns to bear on guide shaft 37 of the device for securing at its end 39 to the suspension member 38 of the lifting device, either by means of a hook, a ring, clip or similar, or by means of one of the two devices 1 described in the above-mentioned patent.

The user may then clamp the strap by acting either on the free strand 6 of this device, or on the suspension means 1, with possible adjustment of length if the latter comprises a complementary shaft for transferring the load from the loop of the strap to the locking shafts.

This intermediate device comprises then, as shown in FIGS. 2 and 3, a yoke shaped piece 2 pierced with two holes 12*a*, 13*a* in which are engaged parallel shafts 3,4 passing through the corresponding holes 12, 13 in case 11. If further comprises extensions of the arms of yoke 2, in the form of lugs 35 pierced with holes 36 for passing therethrough a shaft 37.

The two superimposed strands 5, 6 of the strap are engaged in case 11 and form, by folding back on themselves, loops 7, 8, 9, 10 between which are engaged shafts 3, 4 through the holes 12*a*, 13*a* of the yoke and 12, 13 of the case 11.

These shafts are preferably locked by means of pins 28 engaged in holes in the yoke and in the grooves 27 of the shafts.

The active strand 5 of the strap passes around load 40 before passing behind the guide shaft 37 of the lugs 35 of yoke 2, to extend as far as the suspension point 38 of the lifting apparatus (not shown), for example by means of one of the hook devices 1 described in the above-mentioned patent.

We have seen that the loaded strap assumes a practically vertical position on leaving the hooking device which assumes a slope of about 120° with respect to the horizontal.

Figure 4:
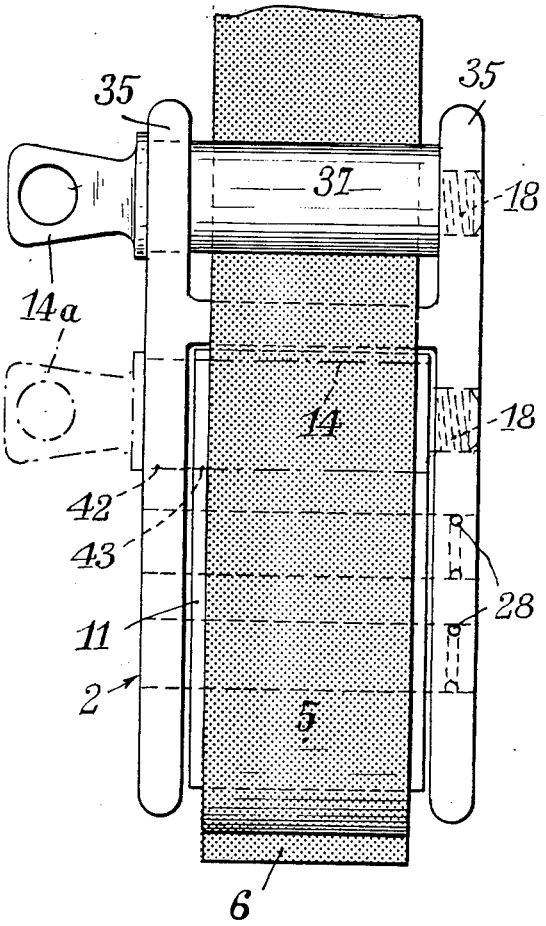
Figure 6:
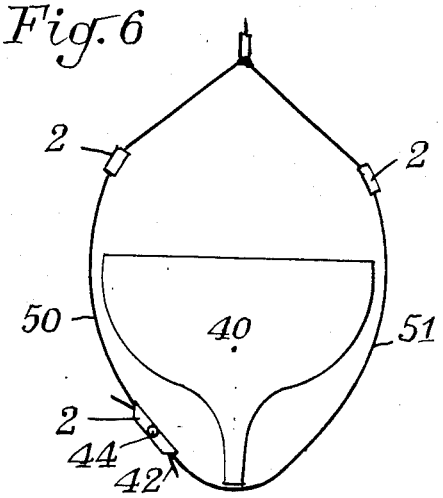
FIG. 6 is a schematical view of an installation for lifting heavy loads by means of two straps, of similar or different design.

This intermediate suspension device may comprise a length adjustment member, as shown in FIGS. 4, 5, inspired by the device of FIGS. 5, 6 of the above-mentioned patent.

A shaft 14 is engaged in the holes 42 of yoke 2 and 43 of case 11 and fixed by screwing or otherwise in an arm of yoke 2 and on this shaft is engaged the active strand 5 of the strap before passing over shafts 3 and 4. Thus, loop 7,8 is unclamped and the length may be adjusted by means of the free strand 6. By removing this shaft 14, the strap is released which then clamps on to shafts 3, 4 as in the embodiment shown in FIGS. 2 and 3.

If this suspension device is not accessible, adjustment of the strap length may also be carried out by means of the device 1 hooked on to the lifting member 38.

Although the diameters of shafts 3, 4, 14 and 37 may be different, it is preferable to choose the same diameters for shafts 14 and 37 which become interchangeable, shaft 14 only being used for adjustment of the length and shaft 37 for guiding the active strand 5 of the strap towards the lifting member.

In some cases, two straps 50, 51 are used, surrounding the load, for example a boat hull, and hooking on to the lifting apparatus, either directly or through at least one locking and adjusting device 2 conformable to the one described in the above-mentioned patent (FIGS. 6 to 9).

It is then necessary to join together the two straps: to this end, two pieces are used such as previously described, identical or not, depending on the nature of the straps 50, 51 to be connected together.

These two pieces 2, 42, in the form of yokes, are coupled head to tail by means of a locking member 44 passing through the holes 36, 46 provided facing each other in lugs 35, 45 of the two pieces. This locking member may be advantageously one of the length adjustment shafts 14, the guide shafts 37 of the single strap of FIGS. 1 to 6 being omitted.

Coupling of these two pieces together is previously effected rectilinearly, but locking thereof allows any other junction.

The user thus has several devices available for locking and length adjustment depending on accessibility thereof.

Figure 8:
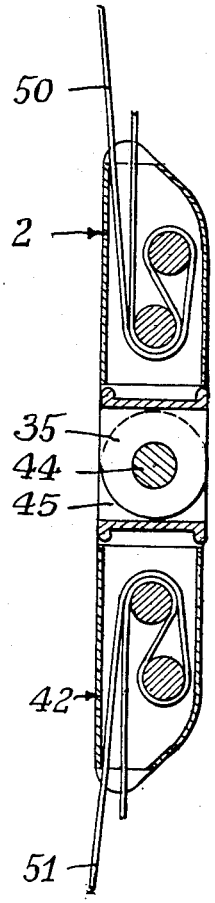
FIG. 8 is a sectional view along line VIII—VIII of FIG. 7.
Figure 9:
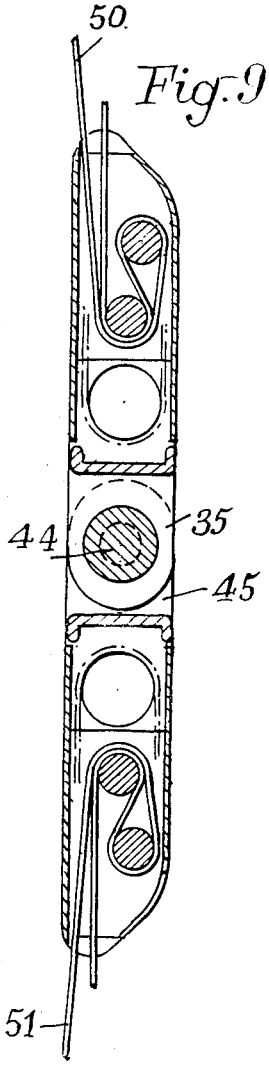
FIG. 9 is a view similar to the preceding one for devices each comprising both members for locking the two straps and members for adjusting the length thereof, although it is possible to provide this variation for only one of the two coupled devices.

To this end, pieces may be used which have no adjustment member (FIGS. 7, 8) or pieces which have one or several locking members, for example two as in the case of FIG. 9.

This construction further allows opening of the strap into two parts, joining of said two parts together, preadjustment of one or other of the two strap parts or better still simultaneous adjustment of both strap parts, a double adjustment practically indispensable for horizontal lifting of long loads, which offers a very appreciable advantage when the load is lifted simultaneously on several lifting straps.

It will be readily understood that the shape of pieces 2 and of their lugs 35, that of the removable case or box 11, particularly the slope of its cover 47 towards its bottom for forming the indispensable slit 11*a*, as well as the means for securing shafts 3, 4, 14, 37 against movement in case 11 may differ from those indicated by way of example in the drawings, without departing from the scope or spirit of the invention.

For engaging the strap in the case or box 11 and winding same in a figure of eight on shafts 3, 4 and possibly 14, a diagram may be provided on one of the faces of the case.

Figure 7:
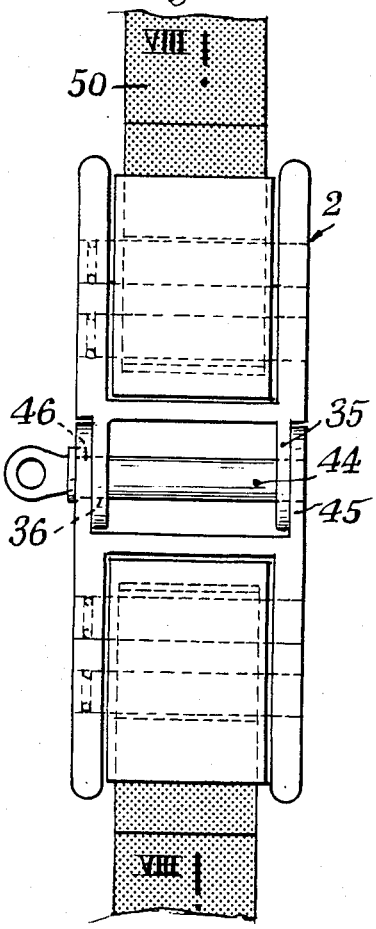
FIG. 7 is a front elevational view of the variation of the device used in this case.

According to a variation of the piece for joining together straps 50, 51, a single piece may be designed formed by welding, one to the other, two locking devices, possibly with adjustment, disposed head to tail as in FIGS. 7 to 9, but without lugs 35.

Figure 10:
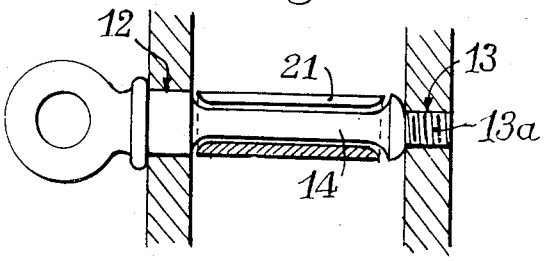
FIGS. 10 and 11 are detail views of a strap length adjustment shaft.
Figure 11:
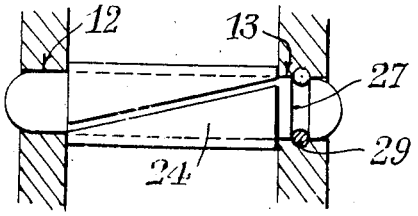

So as to facilitate sliding of the strap over the adjustment shaft 14, this latter shaft may receive a loose or split sleeve 21 or split ring 24 (FIGS. 10 and 11); the locking shafts may be introduced into orifices 12, 13 and be pinned at their ends 12*a*, 13*a* or locked by means of clips 29 engaged in grooves 27 in the shafts.

The device of FIGS. 2 and 3 could comprise a shaft for joining together the lugs 35 of the yoke which would serve as a direct hook.

What is claimed is:

1. A device for locking a strap for lifting loads and securing it to a lifting member, comprising: a yoke shaped piece having arms pierced with two pairs of holes in facing relation, a removable case having sides pierced with two pairs of holes which come into alignment with said holes of the yoke when the case is housed in the yoke, two parallel shafts engaged in the holes of the yoke and the case, means for locking said shafts, said case having a cover bent back towards a bottom portion thereof to form a slit for passing therethrough superposed active and free strands of the strap, before the same is wound into a loop on said shaft for locking thereof, lugs extending from the arms of the yoke, holes provided in facing relation in said lugs, a guide shaft engaged in said holes of said lugs and serving for guiding the active strand of the strap towards the lifting member, and means for locking said guide shaft on the yoke.

2. A device for locking a strap for lifting loads and securing it to a lifting member, comprising: a yoke shaped piece having arms pierced with two pairs of holes in facing relation, a removable case having sides pierced with two pairs of holes which come into alignment with said holes of the yoke when the case is housed in the yoke, two parallel shafts engaged in the holes of the yoke and the case, means for locking said shafts, said case having a cover bent back towards a bottom portion thereof to form a slit for passing therethrough superposed active and free strands of the strap, before the same is wound in a loop over said shafts for locking thereof, a pair of further holes provided in facing relation in the arms of the yoke above the holes through which pass the locking shafts, a shaft engaged in said further holes behind which the strap is wound loosely before engagment thereof over the locking shafts so as to allow length adjustment thereof and removal after adjustment, lugs extending from the arms of the yoke, holes provided in facing relation in these lugs, a shaft engaged in said holes of the lugs for guiding the active strand of the strap towards the lifting member, and means for locking said guide shaft on the yoke.

3. The device as claimed in claim 2, wherein the shafts for adjusting the length of the strap and guiding same are interchangeable.

4. A device for joining together and locking two straps for lifting heaving loads and securing the same to a lifting member, comprising: two similar pieces assembled head to tail, each comprising a yoke having arms pierced with two pairs of holes in facing relation, a removable case having sides pierced with two pairs of holes which come into alignment with said holes of the yoke when the case is housed in the yoke, two parallel shafts engaged in the holes of the yoke and the case, means for locking said shafts, said case having a cover bent back over a bottom portion thereof to form a slit for passing therethrough the superposed active and free strands of the strap before the same is wound into a loop over said shafts for locking thereof, lugs extending from the arms of the yoke and shaped so as to clip on one another, holes provided in facing relation in said lugs, a shaft engaged in said holes of said lugs to lock the assembly of the two pieces, and means for locking said shaft.

5. A device for joining together and locking two straps for lifting heaving loads and securing the same to a lifting member, comprising: two similar pieces assembled head to tail, each comprising a yoke having arms pierced with two pairs of holes in facing relation, a removable case having sides pierced with two pairs of holes which come into alignment with said holes of the yoke when the case is housed in th yoke, two parallel shafts engaged in the holes of the yoke and the case, means for locking said shafts, said case having a cover bent back over a bottom portion so as to form a slit for passing therethrough superposed active and free strands of the strap before the same is wound into a loop on said shafts for locking thereof, a pair of holes provided in facing relation in the arm of the yoke above the holes through which pass the locking means of at least one of the pieces, a shaft engaged in said holes behind which the strap is loosley wound before engagement thereof over the locking shafts so as to allow adjustment of the length thereof and removal after adjustment, lugs extending from the arms of the yoke and shaped so as to clip one on the other, holes provided in facing relation in said lugs, a shaft engaged in said holes of said lugs to lock the assembly of the two pieces, and means for locking said shaft.

6. The device as claimed in any one of claims 1 to 5, wherein the adjustment and guide shafts have on one side a gripping portion and on the other side a threaded portion.

7. The device as claimed in any one of claims 1 to 5, wherein the length adjustment shafts are surrounded by a ring, possibly split.

8. The device as claimed in any one of claims 1 to 5, comprising locking and adjustment devices for hooking straps on to the lifting member.

9. The device as claimed in claim 4 or 5, wherein the two pieces coupled head to tail are formed as a single piece.

* * * * *